US006626655B1

(12) United States Patent
Rivola et al.

(10) Patent No.: US 6,626,655 B1
(45) Date of Patent: Sep. 30, 2003

(54) CASTING MOULD FOR FORMING SANITARY APPLIANCES

(75) Inventors: Pietro Rivola, Imola (IT); Reinhard Wegmann, Villafranca (IT)

(73) Assignee: Sacmi-Cooperative Meccanici Imola-Soc. Coop. A.R.L., Bologna (IT)

( * ) Notice: Subject to any disclaimer, the term of this patent is extended or adjusted under 35 U.S.C. 154(b) by 167 days.

(21) Appl. No.: 09/670,832

(22) Filed: Sep. 28, 2000

(30) Foreign Application Priority Data

Sep. 28, 1999 (IT) ..... RE99A0096

(51) Int. Cl.[7] ..... B28B 1/26

(52) U.S. Cl. ..... 425/84; 425/468; 425/DIG. 58; 425/405.1; 264/318

(58) Field of Search ..... 425/84, 85, 338, 425/405.1, 468, DIG. 58; 249/63, 64; 264/318, 86, 334

(56) References Cited

U.S. PATENT DOCUMENTS 4,130,264 A * 12/1978 Schroer ..... 425/DIG. 58
4,798,525 A * 1/1989 Sato et al. ..... 425/85
4,854,849 A * 8/1989 Sudo ..... 425/DIG. 58
4,915,609 A * 4/1990 Hahn et al. ..... 425/DIG. 58
5,120,211 A * 6/1992 Ito et al. ..... 425/84
5,622,727 A * 4/1997 Cuman et al. ..... 425/84
5,741,388 A * 4/1998 Gerster et al. ..... 425/85
5,858,295 A * 1/1999 McDowell ..... 264/318

FOREIGN PATENT DOCUMENTS

DE 43 10 876 A 10/1994
DE 199 55 629 A 5/2001
EP 0 646 443 A 4/1995

* cited by examiner

*Primary Examiner*—Robert Davis
*Assistant Examiner*—Thu Khanh T. Nguyen
(74) *Attorney, Agent, or Firm*—Birch, Stewart, Kolasch & Birch, LLP

(57) ABSTRACT

A casting mould made of porous material for forming sanitary appliances, including a plurality of profiled parts which are coupled together to define a casting cavity mould said parts being separable from each other for removing a formed appliance from the mould, means for introducing a slip into the mould cavity at least one insert member cooperating with said mould parts to form at least one undercut region in said appliance, wherein said at least one insert member is associated with one of said mould parts by way of a support unit located inside the casting cavity and comprising two mutually movable members, one of which is fixed and secured to one mould part, and the other movable member supports said at least one insert member and is able to move between a first, casting position in which it arranges said at least one insert member in the configuration which enables it to shape said at least one undercut region, and a second, removal position in which it disengages said at least one insert member from said at least one undercut region.

15 Claims, 5 Drawing Sheets

CASTING MOULD FOR FORMING SANITARY APPLIANCES

BACKGROUND OF THE INVENTION

This no-provisional application claims priority under 35 U.S.C. § 119(a) on patent application No. RE99A000096 filed in ITALY on Sep. 28, 1999, which is herein incorporated by reference.

1 . Field of the Invention

The present invention relates generally to the manufacture of sanitary appliances, and more particularly to the casting of appliances of the water closet bowl type.

2.Background Art

In such appliances, the hollow annular upper part of the bowl on which the seat rests is known as the rim.

The rim can be of a closed or open type. In the first case it is in the form of a closed channel in which holes can be provided for feeding the flushing water into the bowl. In the second case it is in the form of a downwardly open channel, ie with its mouth facing the bottom of the bowl.

At the rear of the bowl, the rim is connected to a rear chamber into which the flushing water arrives, and below said connection the bowl has a downwardly extending profiled part forming the central baffle of the seal-trap.

Along the periphery of the rim, at the connection between the water arrival chamber and the downwardly extending wall, there is provided at least one inwardly projecting region or undercut, which gives rise to the problems defined hereinafter.

To manufacture such bowls, casting moulds are known comprising at least two profiled parts formed of a convenient hygroscopic material, for example plaster of Paris, or porous resin.

These can be coupled together to form a casting cavity which is then connected to a specific system for supplying a ceramic material in aqueous suspension, known as slip, and then uncoupled to enable the formed appliance to be removed.

A material layer constituting the wall of the sanitary appliance forms on the permeable hygroscopic portions of the mould.

With each of the mould parts there is associated at least one further part known as an insert, also of hygroscopic material, the purpose of which is to shape the undercuts.

In contrast to the operations involved in coupling and uncoupling the mould parts, which are carried out automatically, the positioning of the at least one insert member prior to complete closure of the mould, and its subsequent removal from the piece formed at the end of the casting cycle, are done manually.

Hence the operators concerned are compelled to carry out repetitive manual operations, which can give rise to problems.

In this respect, these manual operations can result in imprecise positioning of the insert members relative to the respective mould parts, with a consequent reduction in product quality.

In addition, the continuous handling of the insert members can result in their damage, for example chipping due to accidental knocks or falls, with consequent negative repercussions on product quality.

SUMMARY OF THE INVENTION

The main object of the present invention is to obviate the aforesaid within the context of a simple, rational and reliable construction.

The mould of the present invention is of the type defined in the introduction, ie comprising at least two profiled parts to be coupled together to define a casting cavity to be filled with slip, and capable of being uncoupled from each other to enable the formed appliance to be removed from the mould, at least one insert member cooperating with the mould parts to form at least one undercut region in said appliance.

According to the present invention, the at least one insert member is associated with one of said mould parts by way of a support unit located inside the casting cavity and comprising two mutually movable members, one of which is fixed and is secured to said one mould part, and the other of which supports the at least one insert member and is able to move between a first position, known as the casting position, in which it arranges the at least one insert member in the configuration which enables it to shape the at least one undercut region, and a second position, known as the removal position, in which it disengages the at least one insert member from said at least one undercut region.

A control device operable from the outside is interposed between said two members.

Preferably, the control device is connected to a service system which provides a suitable operating fluid, such as water, air or hydraulic oil under pressure.

Specifically, the control device comprises a variable volume chamber which is constructed of an elastically deformable material and is of flat shape with its opposing parallel faces secured to said two members.

When said pressurized fluid is fed into said chamber, the at least one insert is made to assume the casting position, or the removal position, whereas when the fluid is discharged from it the elasticity of its walls results in the at least one insert being made to assume the removal position, or the casting position.

Means cooperating with the elastically deformable material of the variable volume chamber are preferably provided to ensure correct return of the movable member into the removal position or into the casting position.

According to a preferred embodiment, the means consist of mechanical elements, such as tension or compression springs interposed between the two component members of the support unit for the at least one insert member.

Alternatively, the means are associated with the system for supplying the pressurized fluid, and consist of a pneumatic vacuum system to be connected to the elastically deformable chamber after discharge of the fluid present therein.

Means are also provided to ensure that the at least one insert member always maintains the same orientation when in the casting position.

Preferably the means are formed such as to enable the casting orientation to be adjusted as required.

Means are also provided to ensure that the at least one insert follows a determined trajectory during the removal stage and always maintains the same orientation when in the removal position.

In a manner totally similar to the action in the casting position, the means are formed such as to enable the removal orientation to be adjusted as required.

According to the present invention, and as described in detail hereinafter, said means are in the form of a series of adjustable push rods interposed between the two members of the support unit.

By virtue of the aforestated solution all the objects of the present invention are attained in that:

the operators are not required to mount and remove the at least one insert member, there is virtually no risk of damage to the at least one insert member, since it is associated with a mould part which is handled automatically, and correct positioning of the at least one insert member relative to the component parts of the mould is assured.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
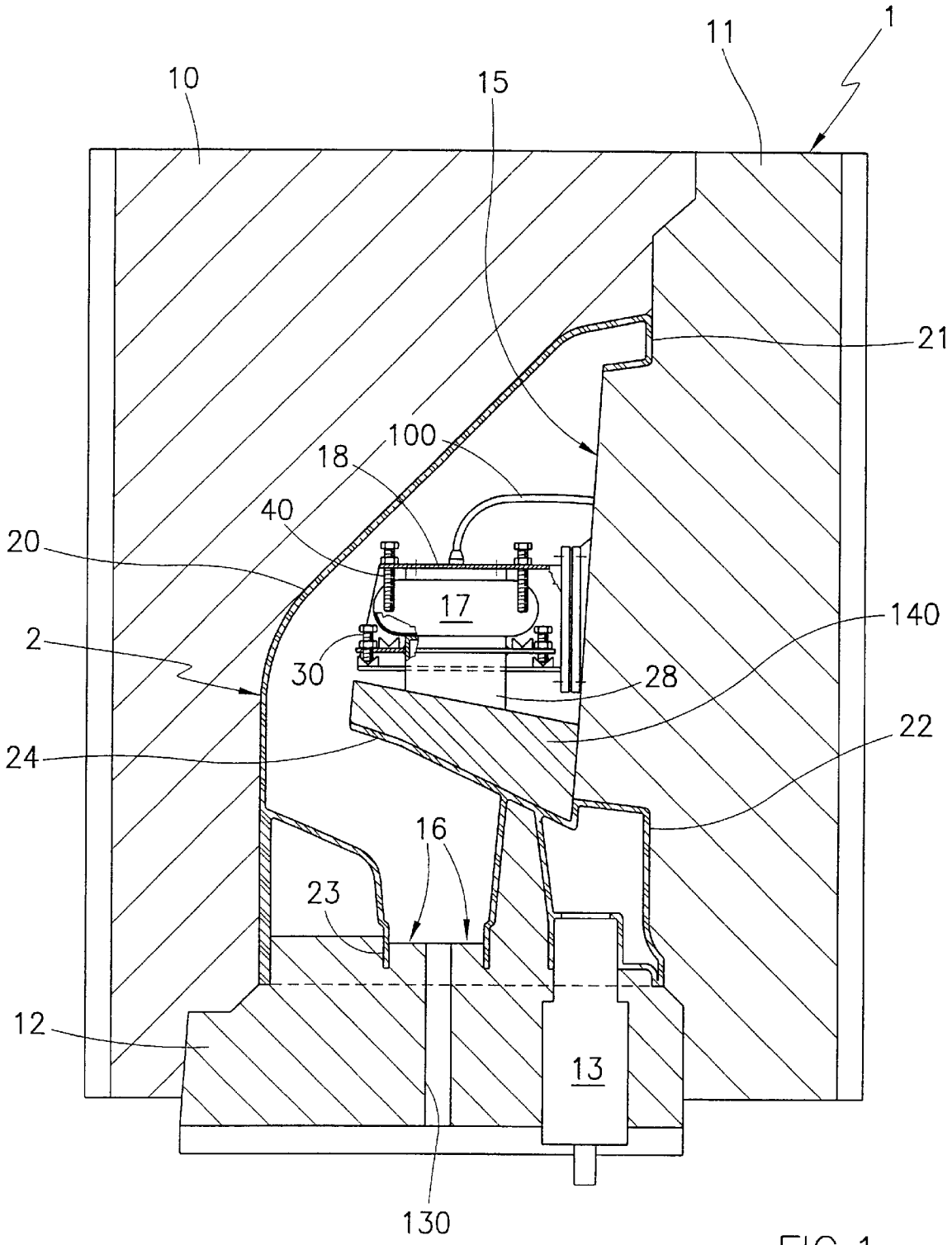
FIG. 1 is a sectional elevation showing a mould of the present invention, assembled and ready for a casting operation, the characteristic means of the invention being shown in full view for clarity.

The figures, and in particular FIG. 1, show a casting mould, indicated overall by the reference numeral 1, provided for forming a water closet bowl 2 of the open rim type.

The mould shown is of the type comprising three profiled parts of hygroscopic material, however the teachings of the present invention can also be applied to moulds having a different number of parts, for example two or four.

Moreover, the type of appliance concerned in the figure is a water closet bowl of open rim type, however the teachings of the invention can also be applied to other types of bowls or other types of sanitary appliances.

Specifically, the mould 1 comprises a lateral part 10 provided for shaping the lower part of the bowl 2 (with reference to its position when in use), an opposing lateral part 11 provided for shaping the upper part of the bowl 2, and a lower part 12 for shaping the rear part of the bowl 2.

The lower part 12 is provided with a channel 130 through which a usual aqueous suspension of ceramic material (slip) is fed into the casting cavity formed by the three mould parts when coupled together as shown.

The lower part 12 also comprises a known insert member 13 by means of which a flushing water feed hole is formed in the bowl 2.

The bowl 2 comprises a pan 20, a discharge 23, a downwardly extending wall 24 positioned to the front thereof and forming a seal-trap, a rim 21, and an arrival chamber 22 for the flushing water.

Some regions of the inner active surfaces of the mould parts 11 and 12 are treated to make them impermeable to prevent the deposition of the ceramic material.

The region 16 is associated with the lower mould part 12 and forms a discharge hole 23, the upper opening of the bowl 2 being formed by the region 15.

The mould is also provided with an insert member 140 forming the downwardly extending wall 24, which is connected at its top to the chamber 22 via an undercut region visible in FIGS. 1 to 4.

According to the present invention, the insert 140 is securely associated with the mould part 11 by the support unit.

This comprises a fixed member secured to the part 11, and a movable member supporting the insert member 140, with an elastically deformable chamber 17 being interposed between these two members.

The fixed member comprises (see FIGS. 2 to 4) a U-shaped body 18 having a transverse plate 19 fixed by screws 190 to a base 25 rigid with the impermeable region 15 of the mould part 11.

A disc 26 is fixed to the base of the U-shaped body 18 by screws 260, the lateral walls of the body 18 each comprising an inwardly extending ledge 180 to which reference is made hereinafter.

The chamber 17 has a flat, circular shape in plan view, and a flexible tube 100 branches from said chamber and passes through the mould part 11 to be connected to an external source of fluid which can be pressurized.

The chamber 17 is constructed of a preferably reinforced elastomeric material, and has its opposing flat faces conveniently fixed, for example by vulcanization, to the disc 26 and to one end of a block 28.

Figure 2:
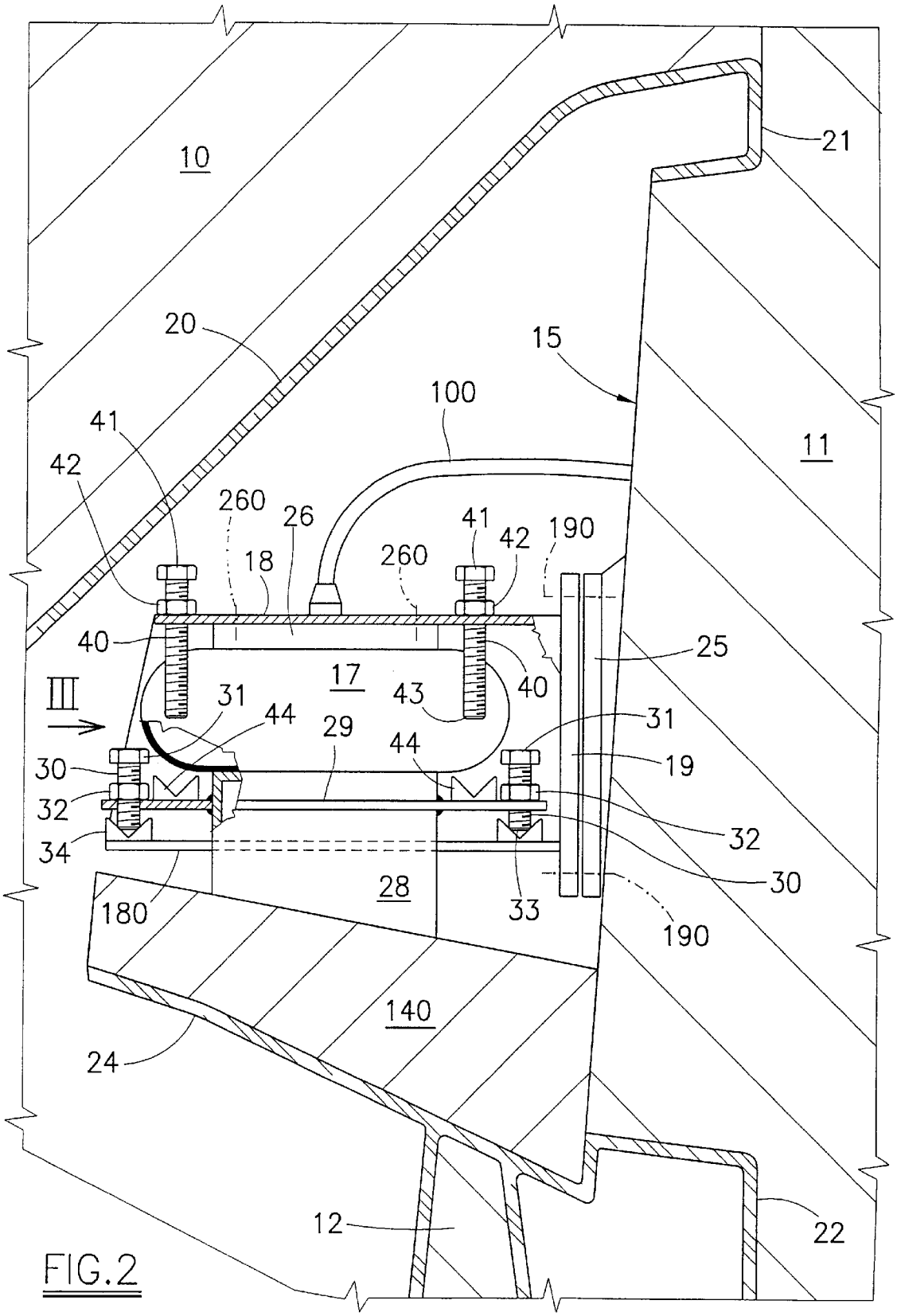
FIG. 2 is a partial sectional enlarged view of part of FIG. 1.
Figure 3:
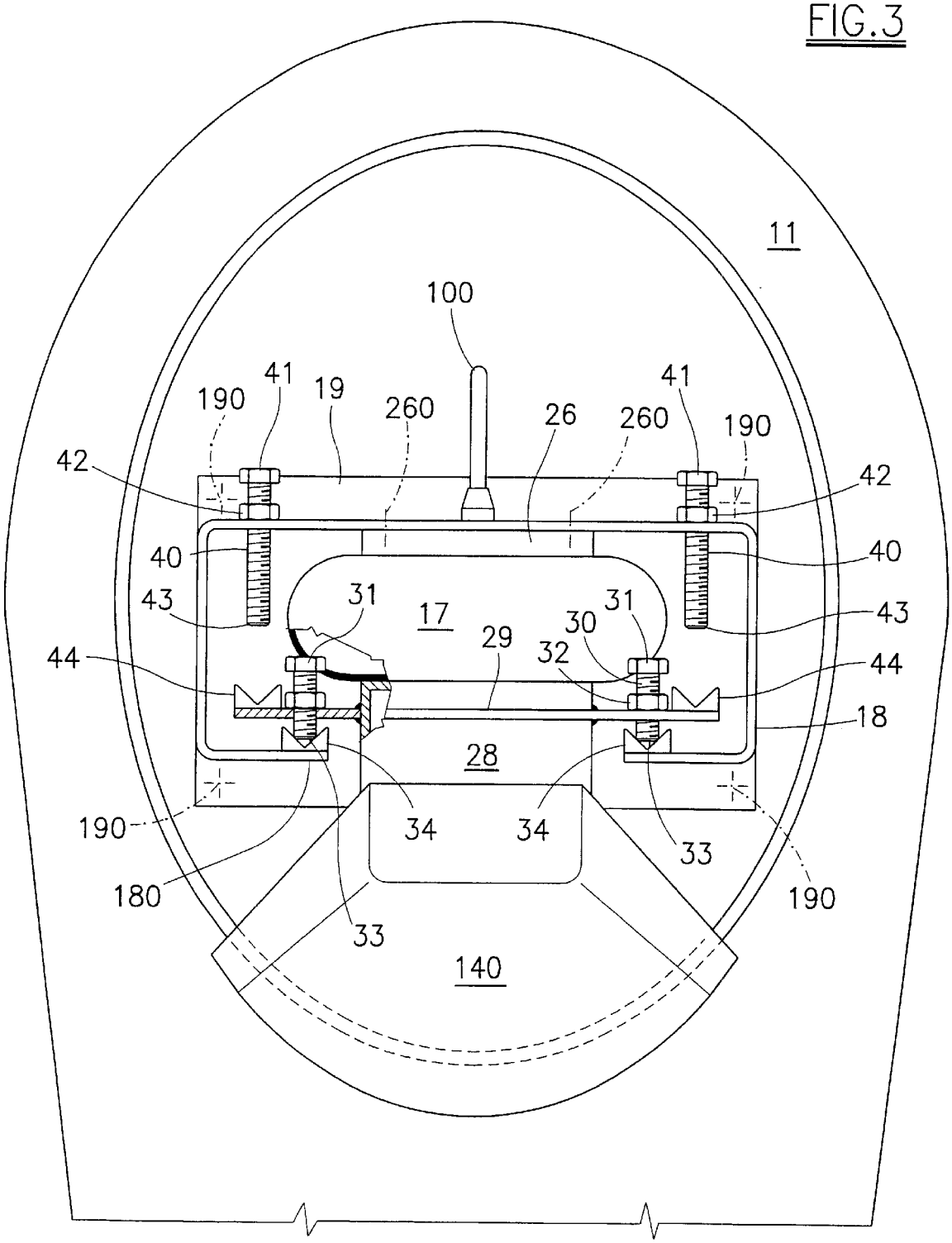
FIG. 3 is a partial sectional view in the direction III of FIG. 2, with the downwardly extending wall forming the central baffle of the bowl seal-trap being omitted for clarity.
Figure 4:
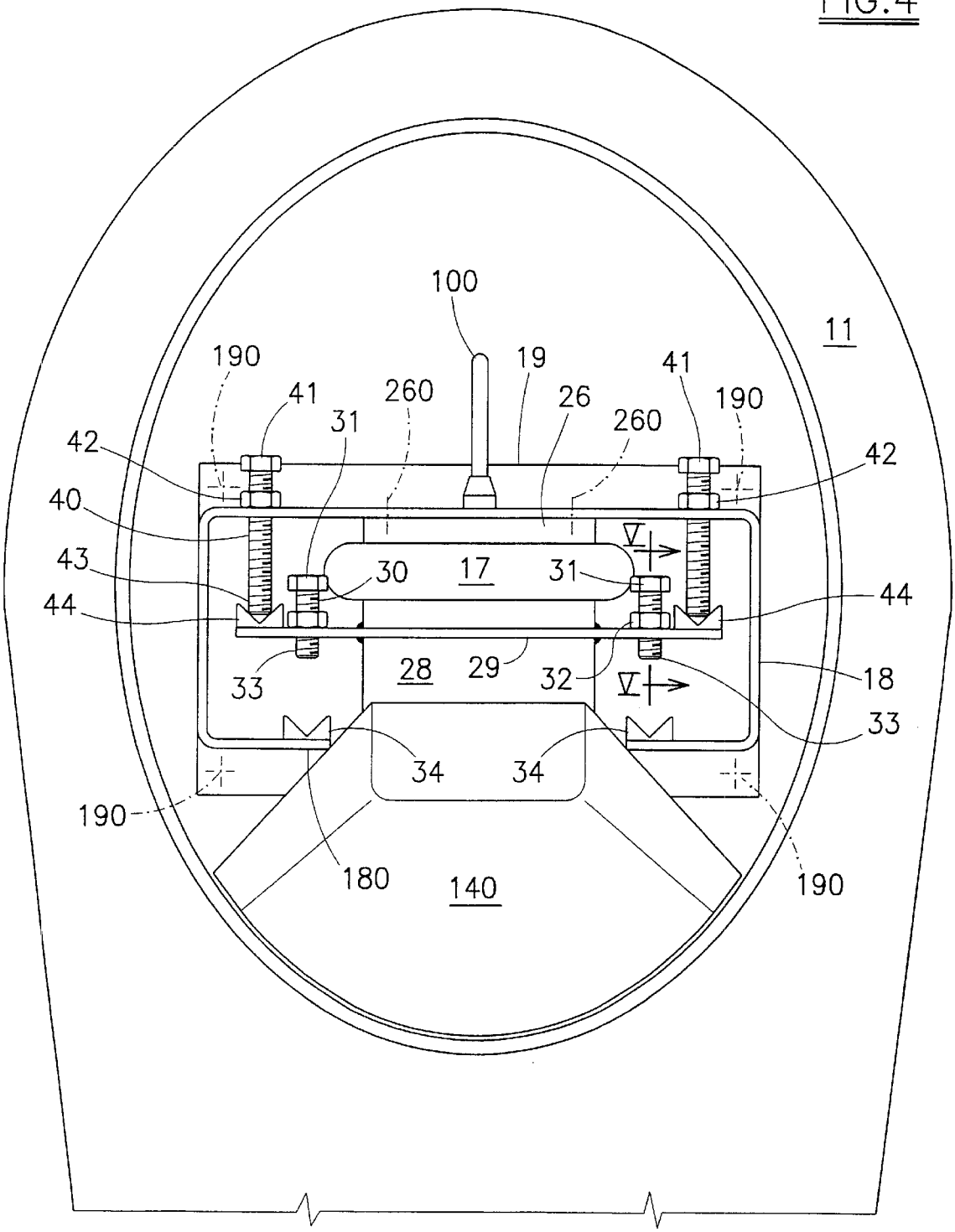
FIG. 4 is a view similar to that of FIG. 3, showing the mould insert member in the position which it occupies prior to mould opening.
Figure 5:
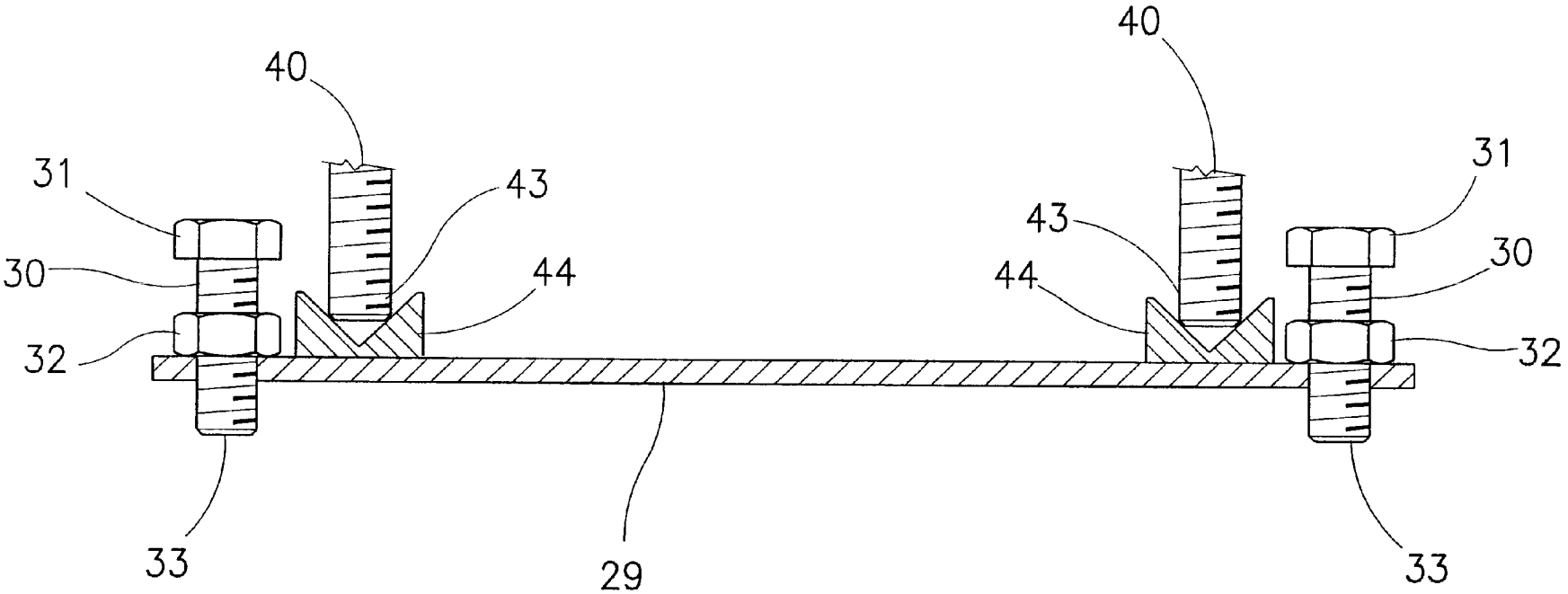
FIG. 5 is a section on the line V—V of FIG. 4 on a larger scale.

The insert member 140 is fixed to the other end of the block 28. To adjustably set the correct operating position of the insert member 140 when in its casting configuration as shown in FIGS. 1 to 3, means described with particular reference to FIG. 5 are provided.

These comprise a continuous frame 29 fixed transversely to said block 28 and having four threaded holes through its corners.

Into each hole there is screwed a threaded pin 30 comprising, starting from that end facing the chamber 17, a terminal operating head 31, an intermediate locking nut 32, and a frusto-conical end tip 33.

In front of the tip 33 there is a projection 34 branching from the respective ledge 180 of the U-shaped body 18, and having in its free end a conical cavity to receive the tip 33.

To adjustably set the correct operating position of the insert member 140 when in its removal configuration, and its trajectory during the removal movement, further means are provided.

These comprise four threaded through holes provided in the base of the U-shaped body 18.

Into each hole there is screwed a threaded pin 40 comprising a terminal operating head 41, an intermediate locking nut 42, and a frusto-conical end tip 43.

In front of the tip there is a projection 44 branching from the frame 29, and having in its free end a conical cavity to receive the tip 43.

The described mould operates as follows.

The mould is closed automatically by known means, the insert member 140 being arranged in its advanced (casting)

position, as shown in FIGS. 1 to 3, either before closure or immediately after, by feeding a pressurized fluid (such as hydraulic oil, air or water) into the chamber 17.

When in said position the insert member 140 is correctly orientated by suitably adjusting the threaded pins 30 with their tips 33 bearing against the respective cavities in the projections 34.

In this position, the insert 140 is insensitive to the thrusts derived from the pressurized feed of the slip into the mould casting chamber.

On termination of casting and before the automatic opening of the mould, the chamber 17 is connected to the discharge and thus deflates.

By this means the insert member 140 (see FIG. 4) is made to withdraw until its outer lower profiled edge lies internal to that edge defining the inner annular opening of the rim 21.

The withdrawal movement is achieved by the intrinsic elasticity of the material forming the chamber 17, however to avoid any problems due to premature ageing of the material, the tube 100 could be connected to a three-position distributor, of which two are operating positions and one is a rest position.

In one of the operating positions it feeds the pressurized fluid to the chamber 17, whereas in the other it connects this tube to a vacuum environment.

The same withdrawal of the insert member 140 to its travel limit can be achieved by mechanical means, for example, by helical springs connected, for example, between the body 18 and the insert 140.

When in this position the insert 140 is correctly orientated and the trajectory undergone is correctly established by suitably adjusting the threaded pins 40 with their tips 43 facing the frame 29 bearing against the respective cavities in the projections extending from the frame 29.

The merits and advantages of the invention and its operation are apparent from the aforegoing and from an examination of the accompanying figures.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A casting mould made of porous material for forming sanitary appliances; which comprises a plurality of profiled parts which are coupled together to define a casting cavity mould said parts being separable from each other for removing a formed appliance from the mould;

means for introducing a slip into the mould cavity at least one insert member cooperating with said mould parts to form at least one undercut region in said appliance, wherein said at least one insert member is associated with one of said mould parts by way of a support unit located inside the casting cavity and comprising two mutually movable members, one of which is fixed and secured to one mould part, and the other movable member supports said at least one insert member and is able to move between a first, casting position in which it arranges said at least one insert member in the configuration which enables it to shape said at least one undercut region, and a second, removal position in which it disengages said at least one insert member from said at least one undercut region.

2. The mould as claimed in claim 1, wherein a control device is interposed between said two movable members.

3. The mould as claimed in claim 2, wherein said control device comprises a variable volume chamber constructed of an elastically deformable material, and is connected to a service system providing a fluid under pressure, and is of a flat shape with its opposing parallel faces secured to said two movable members.

4. A mould as claimed in claim 3, further comprising means for ensuring that the insert member becomes arranged in the second removal position.

5. The mould as claimed in claim 4, wherein said ensuring means are associated with said service system and comprise a vacuum environment to be connected to said variable volume chamber.

6. The mould as claimed in claim 4, wherein said ensuring means are associated with said support unit, and consist of helical springs.

7. The mould as claimed in claim 1, further comprising means for ensuring that said at least one insert maintains its desired position when in said casting position.

8. The mould as claimed in claim 7, wherein said ensuring means are formed in such a manner as to enable said position to be adjusted as required.

9. The mould as claimed in claim 8, wherein said ensuring means are in the form of a series of adjustable push rods interposed between the two members of the support unit.

10. The mould as claimed in claim 9, wherein each of said push rods comprises a threaded shank which is screwed into one of said members of said support unit and comprises a terminal operating head, an intermediate locking nut, and a profiled end tip arranged to engage in a matching rest seat provided on the other member of said support unit.

11. The mould as claimed in claim 1, further comprising means for ensuring that said at least one insert member follows a determined trajectory during the removal stage and always maintains the desired position when in said removal position.

12. The mould as claimed in claim 11, wherein said means are formed in such a manner as to enable said trajectory and said position to be adjusted as required.

13. The mould as claimed in claim 12, wherein said ensuring means are in the form of a series of adjustable push rods interposed between said two members of said support unit.

14. The mould as claimed in claim 13, wherein each of said push rods comprises a threaded shank which is screwed into one of the members of the support unit and comprises a terminal operating head, an intermediate locking nut, and a profiled end tip arranged to engage in a matching rest seat provided on the other member of said support unit.

15. A casting plant for forming sanitary appliances, containing at least one casting mould recited in claim 1.

* * * * *